United States Patent [19]

Chauvigné

[11] 4,069,976

[45] Jan. 24, 1978

[54] OSCILLATING SPRINKLING DEVICE

[75] Inventor: Michel Chauvigné, Cluses, France

[73] Assignee: Etablissements CARPANO & PONS, France

[21] Appl. No.: 705,444

[22] Filed: July 15, 1976

[30] Foreign Application Priority Data

July 22, 1975 France ..... 75 22856

[51] Int. Cl.[2] ..... B05B 3/16

[52] U.S. Cl. ..... 239/242

[58] Field of Search ..... 239/240, 241, 242

[56] References Cited

U.S. PATENT DOCUMENTS

| | | | |
|---|---|---|---|
| 1,187,373 | 6/1916 | Noniya | 239/242 |
| 2,461,768 | 2/1949 | Porter | 239/242 X |
| 3,073,532 | 1/1963 | Rinkewich | 239/242 |
| 3,829,018 | 8/1974 | Oberto | 239/242 |

*Primary Examiner*—John J. Love

*Attorney, Agent, or Firm*—Robert E. Burns; Emmanuel J. Lobato; Bruce L. Adams

[57] ABSTRACT

In an oscillating sprinkling device, control of the change of direction of oscillation of a sprinkler is achieved by deviating a jet of the sprinkling liquid impinging a driving turbine to change the direction of rotation of the turbine.

8 Claims, 8 Drawing Figures

OSCILLATING SPRINKLING DEVICE

BACKGROUND OF THE INVENTION

The invention concerns sprinkling devices of the type comprising an oscillating sprinkler element which pivots about an approximately horizontal axis alternately in one direction of rotation and the other in response to the rotation of a rotary driving element by the pressure of a sprinkling liquid in one direction of rotation or the other. The oscillating sprinkler element has one or several parts which cooperate, at the end of rotation in each direction, with means for controlling the change of direction of the rotary driving element. Such devices are useful for sprinkling various liquids, such a water, manure, pesticide and so on.

In known devices of this type, such as those described in French Pat. Nos. 2,034,814 and 2,112,881, the rotary driving element is alternately driven by either of two jets of sprinkling liquid issuing from either one of two fixed pipes suitably directed towards the rotary driving element. The inlet orifices of the two pipes are connected to a chamber containing the liquid under pressure; opening of these orifices is controlled by a double clapper arranged so that one orifice is open while the other is closed, which allows the liquid to flow in only one of the pipes at a time, then in the other. The oscillating sprinkler element includes parts which, at the end of rotation in either direction, act on control means actuating the double clapper. For such devices to operate correctly, it is necessary for the fluid-tightness of the clapper to be relatively good so that the sprinkling liquid flows, at a given instant, in only one of the pipes, the other being closed. If the fluid-tightness of the clapper is faulty, liquid will flow through an orifice that should be closed and oppose rotation of the rotary driving element.

SUMMARY OF THE INVENTION

The invention aims to provide a device which enables the sprinkling of a liquid on a substantially rectangular surface, while ensuring a regular distribution of the liquid on this surface, and which incorporates a mechanism that is relatively easy to make since it is composed of few parts and does not involve problems of fluid-tightness so that the parts do not need to be manufactured to close tolerances as in the prior art devices.

The sprinkling device according to the invention comprises a rotary motor element, which may for example be a turbine, actuable by the pressure of a sprinkling liquid alternately in one direction of rotation or the other. An oscillating sprinkler element, permanently kinematically connected to the rotary driving element, pivots about an approximately horizontal axis alternately in one direction of rotation or the other according to the direction of rotation of the rotary driving element. Means are provided for controlling, at the end of rotation of the sprinkler element in either direction, the change of direction of the rotary driving element, these control means being arranged to deviate a jet of liquid under pressure from a single supply duct, alternately in first and second directions each corresponding to one of the directions of rotation of the rotary driving element.

According to an embodiment of the invention, the means arranged to deviate the jet of liquid are formed by a deflecting device disposed between an outlet of the single duct and the rotary driving element. This deflecting device may occupy either of two positions each corresponding to one of the two directions of deviation of the jet. It is for example formed of a mobile element having a planar or non-planar face able to be displaced and oriented in front of the jet of liquid, or two opposite planar or non-planar faces disposed on either side of a common pivoting axis disposed substantially facing the jet of liquid. Such a pivoting axis can have any position whatsoever between the two faces of the deflecting device; it may for example be disposed between the median parts of the two faces or nearer one of their ends.

The deflecting device may also be formed for example by a mobile wedge-like element having two inclined faces whose common edge is directed towards the outlet of the single duct, this mobile element being movable transversely in front of the outlet of the duct in a manner to alternately place each of said faces in the trajectory of the liquid. The two faces may have various shapes: they may for example be plane or incurved in gutter-shape over all their surface or only in the proximity of their common edge. These two faces may advantageously be completed by supplementary facing walls which define passages guiding the deviated jet of liquid. Transverse movement of the mobile element may take place along a rectilinear or non-rectilinear guide, or about a pivoting axis disposed for example in a direction opposite to that of the common edge of the two faces, this pivoting axis advantageously being disposed coaxially to that of the rotary driving element, but it could equally well be further away from the jet than the axis of the rotary driving element.

According to another embodiment of the invention, the means for deviating the jet of liquid enable at least the outlet of the duct to be alternately moved; the duct may for example be extended by a flexible pipe whose outlet end can be deviated in one direction or the other. Alternatively, the duct could be formed of a rigid material and be articulated near its inlet.

BRIEF DESCRIPTION OF THE DRAWING

The accompanying drawings show, by way of example, several embodiments of oscillating sprinkling devices according to the invention. In the drawings.

DESCRIPTION OF THE PREFERRED EMBODIMENTS

Figure 1:
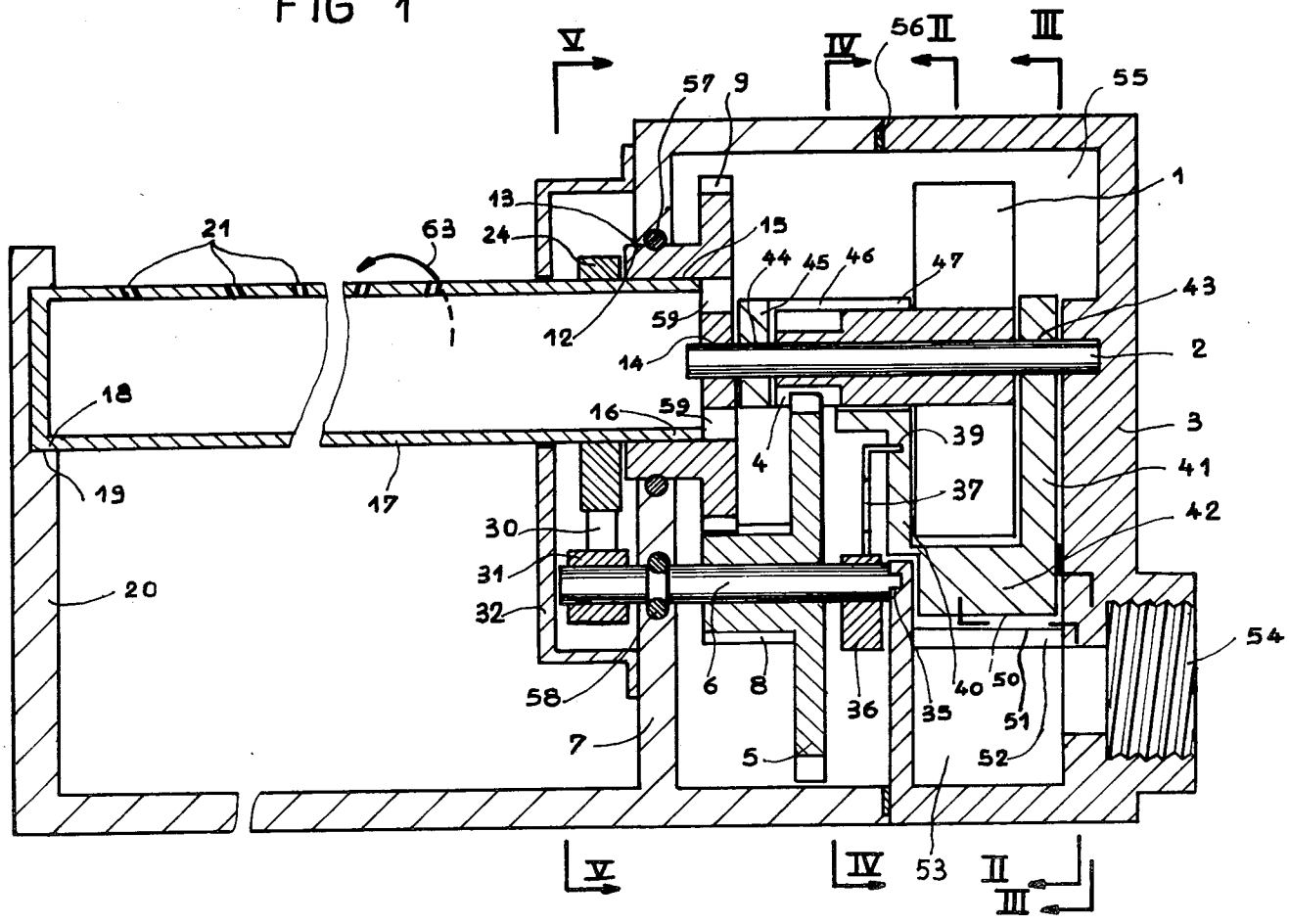
FIG. 1 is a cross-section along line I—I of FIG. 4 of a first embodiment.

The oscillating sprinkling device shown in FIGS. 1 to 5 comprises a rotary driving element formed by a turbine 1 pivoted about a shaft 2 a first end of which is supported by a first casing 3. A toothed pinion 4 fixed with the turbine 1 is constantly in mesh with a toothed wheel 5 pivoted on a shaft 6 of which a first end is supported by a second casing 7. A toothed pinion 8, integral with wheel 5, is constantly in mesh with a toothed wheel 9 which is extended by a sleeve 12 having an external cylindrical part 12 journalled in an inner cylindrical part 13 of the second casing 7. Wheel 9 also has an axial hole 14 receiving the second end of shaft 2. The sleeve of toothed wheel 9 defines an inner cylindrical axial housing 15 in which is introduced a first end 16 of a sprinkling element formed by a tube 17 which is thus axially disposed to the shaft 2. This first end 16 of the tube 17 is fixed with the toothed wheel 9 whereas its second end 18 is pivotally mounted in a bearing 19 provided in an arm 20 extending from the second casing 7. The tube 17 has several orifices 21 oriented to sprinkle a rectangular surface as the tube 17 oscillates.

Figure 4:
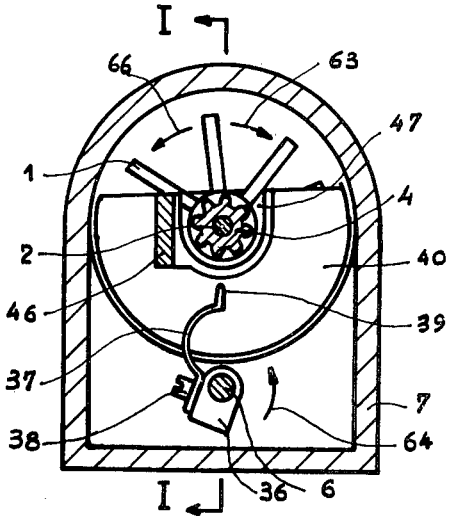
FIG. 4 is a cross-section along the line IV—IV of FIG. 1.
Figure 5:
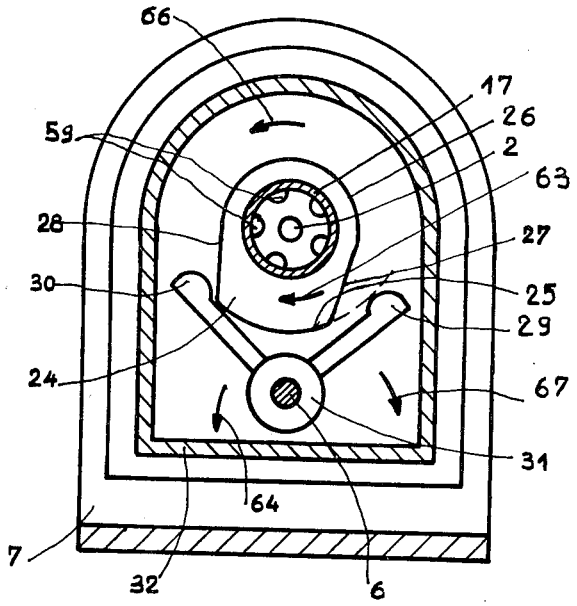
FIG. 5 is a cross-section along line V—V of FIG. 1.

A cam 24 is fixed on the first end 16 of tube 17. As shown in FIG. 5, cam 24 has an upper-level zone 25 and a low-level zone 26 joined by inclined faces 27 and 28. Facing the cam 24 are disposed two levers 29 and 30 positionally fixed in relation to one another and integral with a hub 31 fixed on the first end of the shaft 6, which extends beyond casing 7. The cam 24 and levers 29 and 30 are protected by a cover 32 fixed on the second casing 7. The second end of shaft 6 is journalled in a bearing 35 of the first casing 3. As shown notably in FIG. 4, a support 36 is fixed on the shaft 6 between the toothed wheel 5 and the first casing 3. A cambered spring wire 37 has a first end fixed to the support 36 by a screw 38, and a second bent end (see FIG. 1) introduced in an orifice 39 in which it can turn. This orifice 39 is provided in one, 40, of two substantially semi-circular cheeks 40 and 41 disposed on either side of the turbine 1 and pivoted about the axis of shaft 2.

Figure 2:
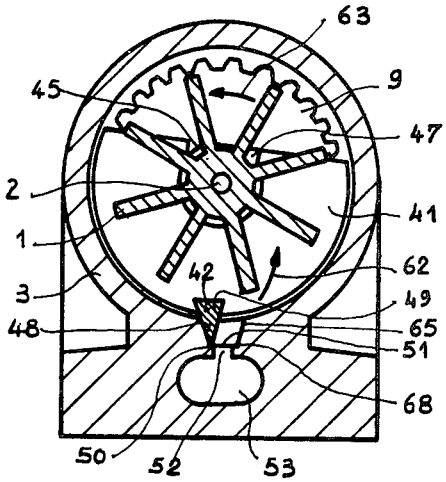
FIG. 2 is a cross-section along line II—II of FIG. 1.
Figure 3:
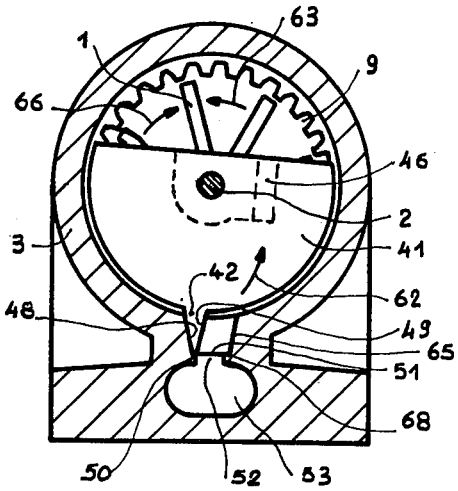
FIG. 3 is a cross-section along line III—III of FIG. 1.

The lower part of each of the cheeks 40 and 41 supports a deflector 42, visible on FIGS. 1, 2 and 3. Deflector 42 is pivoted about the shaft 2, on the one hand by an opening 43 in the cheek 41, on the other hand by an opening 44 in an extension 45 of cheek 40, this extension 45 been connected to the cheek 40 by a part 46 disposed parallel to the shaft 2 (FIGS. 1,3 and 4). A notch 47 in cheek 40 permits the passage of toothed pinion 4. The deflector 42 has two inclined faces 48 and 49 meeting at a common edge 50 directed into an outlet 51 of a single duct 52 leading to a chamber 53 communicating with a threaded inlet orifice 54 to which an inlet pipe, not shown, is connected for the supply of sprinkling liquid.

The principal parts of the driving mechanism of the sprinkling device are thus disposed in a chamber 55 formed by the two casings 3 and 7, this chamber being filled with sprinkling liquid when the device is in use. Chamber 55 is made fluid-tight by: a washer 56 placed between the joined faces of the casings 3 and 7; a toric O-ring joint 57 placed between the external cylindrical part 12 and the inner cylindrical part 13; and a toric O-ring joint 58 placed between the shaft 6 and the bearing of casing 7 in which shaft 6 is disposed. Fluid-tightness between the inner cylindrical part 15 and the end 16 of tube 17 is ensured for example by force-fitting or welding tube 17 in part 15. Openings 59 are provided in the toothed wheel 9 to allow the passage of sprinkling liquid from chamber 55 into tube 17.

During operation, liquid penetrates into the device by the inlet orifice 54, chamber 53 and duct 52. As the jet of liquid passes through the outlet 51 of duct 52, it comes, as shown in FIGS. 2 and 3, to hit the face 49 which deviates it in the direction indicated by arrow 62, so that the turbine 1 is rotated according to arrow 63. By the intermediate of pinion 4, wheel 5 and pinion 8, the wheel 9 is also rotated according to 62 together with the tube 17, but at a much slower speed than turbine 1. At the same time, the sprinkling liquid which had driven the turbine 1 passes through chamber 55 and orifices 59 into tube 17, and is projected by its pressure through the orifices 21. Simultaneously, cam 24 is rotated by tube 17 according to 63. As shown in FIG. 5, at a certain moment, the inclined face 28 pushes back lever 30 which rotates shaft 6 and support 36 according to 64. The cambered spring wire 37 is gradually stressed until the moment when this stressing reaches a maximum and the cheek 40 is abruptly rotated according to 63, so that deflector 42 abruptly changes position to come to be placed against face 65, the jet of liquid thus hitting face 48 of deflector 42. Instantaneously, the direction of rotation of turbine is reversed, so that it turns according to 66 (FIGS. 3, 4 and 5). Simultaneously, tube 17 also turns according to 66; after a certain period of time, the tube 17 passes by a position in which the liquid is projected vertically by the orifices 21, then a rectangular surface, symmetrical to the previously sprinkled surface, is sprinkled until the moment when the inclined face 27 of cam 24 actuates lever 29 according to 67. When the tumbler system formed by the support 36, spring wire 37 and cheek 40 has once more operated, the elements return to the position shown in FIGS. 2 to 4, and the operation repeats cyclically.

FIGS. 2 and 3 show that in the two positions it occupies facing the jet of liquid, the edge 50 of deflector 42 is nested in a respective one of two recesses 68 disposed on either side of the outlet 51 of duct 52. The jet of liquid thus impinges against one of the lateral faces of the deflector 42 without meeting edge 50.

Figure 6:
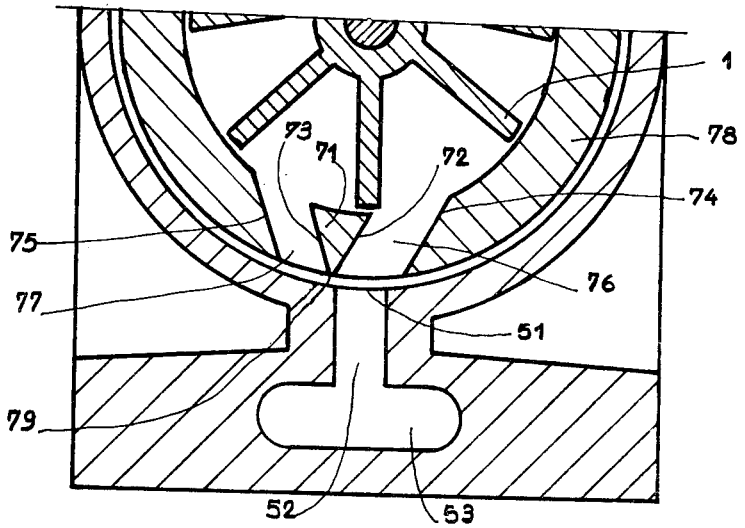
FIG. 6 is a cross-section similar to FIG. 2 of a second embodiment.

In the second embodiment, shown in FIG. 6, the recesses 68 are dispensed with and the deflector 42 is replaced by a wedge-like deflector 71 having inclined faces 72 and 73 facing corresponding inclined walls 74 and 75 to define two passages 76 and 77 which guide the deviated jet. In this case, the cheeks 40 and 41 are united by a wall 78 in which the passages 76 and 77 are provided. As shown, the edge, 79, between the two faces 72 and 73 preferably occupies a slightly offset position in relation to the outlet 51 of orifice 52. The jet of liquid thus hits the faces of the respective passage, but not edge 79. All the other elements are identical to those of the first embodiment and operation is the same.

Figure 7:
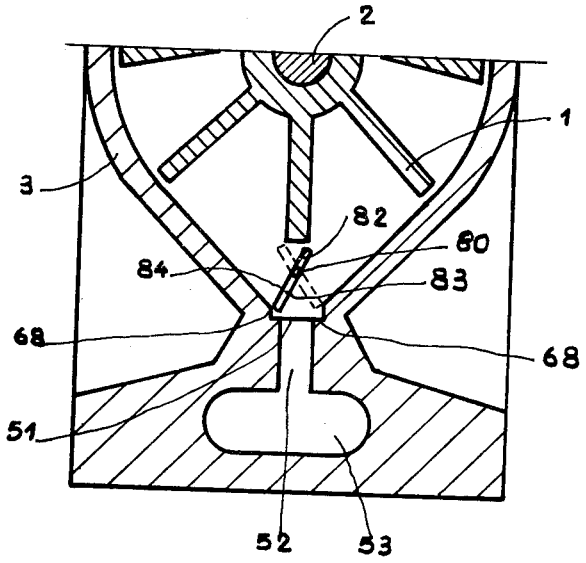
FIG. 7 is a cross-section similar to FIG. 2 of a third embodiment.

In the third embodiment, shown in FIG. 7, the deflector 42 and the cheeks 40 and 41 of the first embodiment are replaced by a flat deflector 82 having two opposite faces 83 and 84 disposed on either side of a pivoting shaft 80 parallel to shaft 6. The orifice 39 receiving the end of spring wire 37, not shown in FIG. 7, is provided for example in the end of deflector 82. All of the other elements are identical to those of the first embodiment. Operation is the same: changing of the direction of rotation of turbine 1 is controlled by changing the angular position of the deflector 82 between the two positions shown in FIG. 7, in which the end of deflector 82 adjacent the outlet 51 of duct 52 is lodged in one of two recesses 68.

Figure 8:
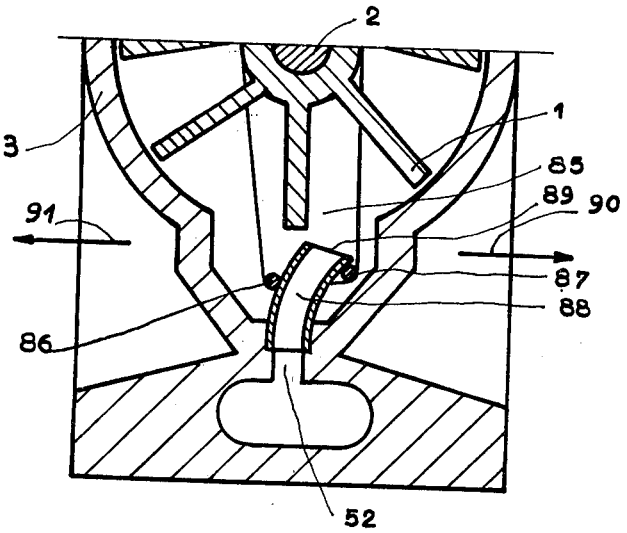
FIG. 8 is a cross-section similar to FIG. 2 of a fourth embodiment.

The fourth embodiment, shown in FIG. 8, comprises a pivoted support 85, able to turn on shaft 2. Support 85 includes the orifice 39, not shown in FIG. 8, in which the end of the spring wire 37 is lodged, and extends to an end carrying two studs 86 and 87 on either side of a flexible pipe 88. The inlet of pipe 88 is firmly fixed to the outlet of duct 52 and its outlet is free to be abruptly moved according to arrows 90 and 91 by the studs 86, 87. Deviation of the jet of liquid is thus obtained by moving the outlet of the flexible pipe 88. The other elements, and operation, are the same as for the first embodiment.

The described oscillating sprinkling devices are of reliable operation and involve no problem of fluid-tightness of a clapper.

The described devices operate during long periods of time without it being necessary to carry out any maintenance, operation always being sure and reliable even in the case when foreign bodies are contained in the liquid.

What is claimed is:

1. An oscillating sprinkling device, comprising; a rotary driving element rotatable by a sprinkling liquid alternately in one direction of rotation and the other; a sprinkler element mounted for oscillating rotation and permanently kinematically connected to the rotary driving element, the sprinkler element pivoting about an approximately horizontal axis alternately in one direction of its oscillating rotation and the other, according to the rotation of the rotary driving element; control means for effecting at the end of the pivoting of the sprinkler element in either direction, a change of the direction of rotation of the rotary driving element; and duct means defining a duct for supplying the rotary driving element with a jet of sprinkling liquid under pressure, the duct means having a movable outlet part; the control means comprising an element for deviating the jet of liquid from the movable outlet part of the duct alternately in first and second directions, each corresponding to one of the directions of rotation of the rotary driving element, the deviating element cooperating with the movable outlet part of the duct to move the element in first and second directions of deviation of the jet.

2. A sprinkling device according to claim 1, in which the duct is generally fixed and the deviating element is a deflector disposed at the movable outlet part of the duct and enabled to occupy first and second positions corresponding to the first and second directions of deviation of the jet.

3. A sprinkling device according to claim 2, in wich said deflector defines at least one wall of a passage through which the jet of liquid passes.

4. A sprinkling device according to claim 3, in which said deflector has two faces opposed to one another and is pivotally mounted about an axis disposed between said faces and facing said duct.

5. A sprinkling device according to claim 3, in which said deflector has two inclined faces with a common edge directed towards an outlet of the duct, said deflector been movable transversally in front of said outlet to alternately place each of its faces in the trajectory of the jet of liquid.

6. A sprinkling device according to claim 5, in which the deflector is pivotally mounted about an axis spaced apart from said outlet of the duct beyond said common edge of the two faces.

7. A sprinkling device according to claim 6, in which the pivoting axis of the deflector is coaxial to that of the rotary driving element.

8. A sprinkling device according to claim 5, in which said inclined faces of the deflector are associated with respective facing walls of the deflector to define two passages for guiding the deviated jet of liquid.

* * * * *